United States Patent [19]

Jahn

[11] Patent Number: 5,016,529

[45] Date of Patent: May 21, 1991

[54] SHEET-FED ROTARY PRINTING PRESS FOR MULTI-COLOR PRINTING

[75] Inventor: Hans-Georg Jahn, Weisenbach, Fed. Rep. of Germany

[73] Assignee: Heidelberger Druckmaschinen AG, Heidelberg, Fed. Rep. of Germany

[21] Appl. No.: 475,220

[22] Filed: Feb. 5, 1990

[30] Foreign Application Priority Data

Feb. 3, 1989 [DE] Fed. Rep. of Germany ... 8901222[U]

[51] Int. Cl.[5] ..... B41J 5/00

[52] U.S. Cl. ..... 101/211; 101/183; 101/229

[58] Field of Search ..... 101/183, 184, 180, 181, 101/229, 230, 211

[56] References Cited

U.S. PATENT DOCUMENTS 4,621,576 11/1986 Wirz ..... 101/230

FOREIGN PATENT DOCUMENTS 0132859 2/1985 European Pat. Off. ..... 101/184

*Primary Examiner*—Edgar S. Burr
*Assistant Examiner*—C. Bennett
*Attorney, Agent, or Firm*—Nils H. Ljungman & Associates

[57] ABSTRACT

The invention relates to a sheet-fed rotary printing press for multi-color printing with an in-line arrangement of the printing units. Each printing unit comprises a plate cylinder, a blanket cylinder and an impression cylinder, all of a single diameter, as well as three sheet-transfer drums. The sheet-transfer drums of single diameter are provided for printing jobs using a one-sided multi-color printing process. On the other hand, the design for recto-and-verso printing is provided with a storage drum and a turning drum, with the storage drum being of double diameter. Depending on the job structure, the printing press according to the invention can later be converted at the printing shop from one design to the other.

12 Claims, 2 Drawing Sheets

SHEET-FED ROTARY PRINTING PRESS FOR MULTI-COLOR PRINTING

BACKGROUND OF THE INVENTION

1. Field of the Invention

The invention relates to a sheet-fed rotary printing press for multi-color printing with an in-line arrangement of the printing units and, more specifically, such a printing press which can be readily converted from recto printing to recto-and-verso printing.

2. Description of the Prior Art

A known printing unit can include a plate cylinder, a blanket cylinder and an impression cylinder, all of which have a single, common diameter. Such a unit can also include three sheet-transfer drums and may be of the type disclosed in German Patent No. 17 61 780. The impression cylinder of each printing unit of such a machine and the sheet-transfer drums or transfer drums that are arranged between two printing units are also of the same single diameter and are not intended for the turning of the sheets to be printed.

OBJECTS OF THE INVENTION

It is an object of the invention to provide a high-performance sheet-fed rotary off-set printing press for one-sided multi-color printing, which printing press is adapted to be selectively converted at any time from purely recto printing to recto-and-verso printing.

It is another object to provide such a printing press in which the smear-free processing of paper can be guaranteed while using identical side walls of the printing units in both designs.

SUMMARY OF THE INVENTION

A sheet-fed rotary printing press according to the invention may be designed in such a manner that the sheet-transfer drums or transfer drums cooperating with the impression cylinders are of the same single diameter. With such a configuration, the printing press can be employed for and is especially advantageous for one-sided multi-color printing. The sheet-transfer drums of single diameter include no other guiding components apart from the gripper systems, which hold the sheet by its front edge.

Should, for example, a job structure or requirement at the printing shop be changed during the course of operation of a printing press according to the invention, either one of the two selective designs being employed in the printing shop can be converted to the other. In the preferred printing press of the invention, provisions have already been made for such conversion in the side walls of the printing units.

The present invention can be advantageously employed even if there are numerous, independent demands for the sheet-fed rotary printing press for one-sided multi-color printing and for the reversible recto-and-verso printing with no desire or plans for conversion of one to the other. The use of the preferred side walls according to the invention is economical in production terms as well as advantageous for the planning of production and assembly, regardless of whether or not a conversion is to be performed later.

If an embodiment of the invention is for being converted from recto printing to recto-and-verso printing, it must include at least one turning station. In such a sheet-fed rotary printing press, the middle sheet-transfer drum between two printing units is of double diameter (twice the single diameter) and is designed as a storage drum. Additionally, in place of one of the sheet-transfer drum of single diameter, a turning drum is positioned after the storage drum. It is advantageous, with this particular cylinder arrangement, that only one pincer gripper system is disposed in the turning drum.

DESCRIPTION OF THE PREFERRED EMBODIMENTS

Figure 1:
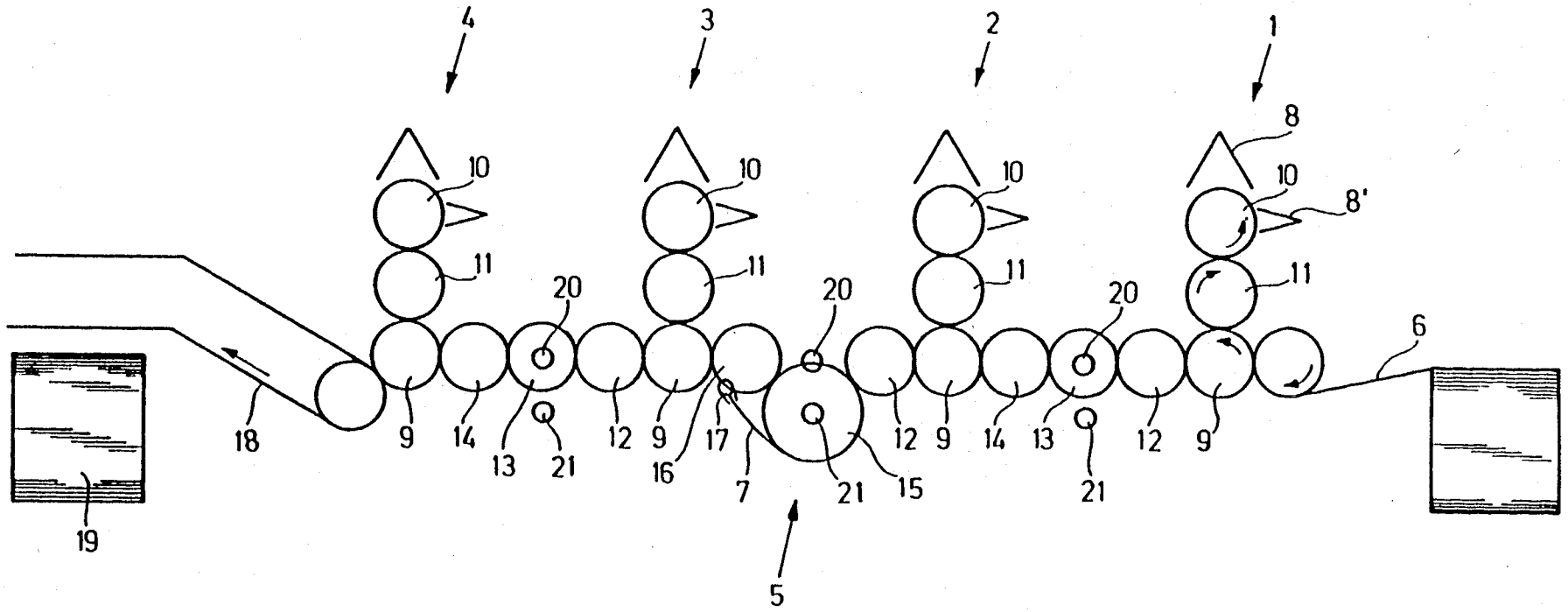
FIG. 1 is a schematic view of a preferred printing press including various features of the invention.
Figure 2:
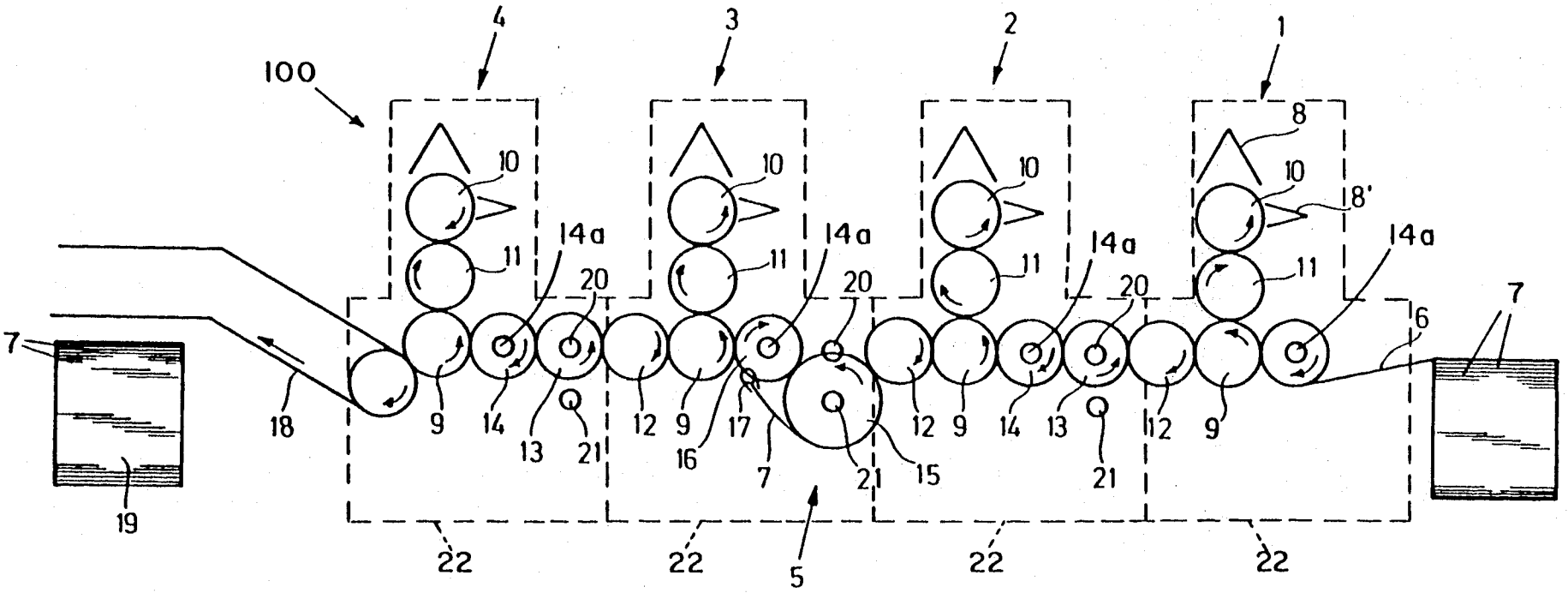
FIG. 2 is a schematic view similar to that of FIG. 1 including additional features of the invention.

The preferred sheet-fed printing press 100 is shown schematically in FIGS. 1 and 2 and includes four printing units 1, 2, 3 and 4, with a turning station 5 being operatively located between printing unit 2 and printing unit 3. The sheets 7 to be processed are fed from a supply stock to the impression cylinder 9 of printing unit 1 by a sheet feeder 6. Each sheet 7 receives its first ink application by means of plate cylinder 10 and blanket cylinder 11, which have similar, single diameters as the single diameter of the impression cylinder 9. Assigned in a known manner to each plate cylinder 10 are an inking unit 8 and a damping unit 8'.

After the first ink application in unit 1, the impression cylinder 9 of unit 1 passes the printed sheet 7 to sheet-transfer drums 12, 13 and 14, which also have the single diameter to be received on the impression cylinder 9 of the printing unit 2. The sheet-transfer drum 14 is mounted for rotation at bearing support means **14*a* (FIG. 2) to be disposed in cooperation with the impression cylinder 9. The second color is applied at the printing unit 2 by way of its plate cylinder 10 and blanket cylinder 11**.

As mentioned hereinabove, the turning station 5 includes a preferred storage drum 15 of a double diameter which is twice the single diameter. The storage drum 15 is selectively provided between printing unit 2 and printing unit 3 in a location which could alternately include a sheet-transfer drum 13. Positioned after the storage drum 15 in the turning station 5 is a turning drum 16 of the single diameter.

Accordingly, after the second inking at unit 2, the sheet 7 is accepted by the sheet-transfer drum 12 and is fed to the storage drum 15. The storage drum 15 includes two gripper systems (not shown) which are located 180 degrees from each other on the circumference of the storage drum 15. As the sheet 7 is fed to the drum 15 one of the gripper systems takes hold of the aligned front edge of the sheet 7. A suction apparatus associated with the drum 15 applies a suction on the sheet at its rear edge. As a result, the sheet is under tension in the circumferential and lateral directions.

In order to complete the turning process, a turning drum 16 is disposed in the printing unit 3 in place of a sheet-transfer drum 14. The turning drum 16 has the single diameter and includes a pincer gripper system 17. The turning drum 16 is selectively mounted for rotation at the bearing support means **14*a* for being in cooperation with the impression cylinder 9. As seen in FIGS. 1 and 2, in the recto-and-verso printing position, the pincer gripper system 17 takes hold of the sheet 7 at its rear edge and thus feeds it, rear edge first, to the impression cylinder 9 of the printing unit 3. The first verso inking occurs in the unit 3 through the use of a plate cylinder 10 and a blanket cylinder 11 as described for units 1 and 2. As a result, it should be clear that the turning station 5 includes the storage drum 15 and the turning drum 16**.

The printing unit 4 is preferably of the same design as printing unit 2. Accordingly, unit 4 employs sheet-transfer drums 12, 13 and 14, all of the single diameter, and an impression cylinder 9, a plate cylinder 10 and a blanket cylinder 11, each of the single diameter. In printing unit 4, the sheet 7 obtains its second verso inking and is finally deposited on a delivery pile 19 by a sheet delivery system 18. The impression cylinder 9 in the printing units 3 and 4 is preferably provided with readily inking packings.

As best seen in FIG. 2, the preferred printing press 100 includes features to make it readily adapted and altered for various printing methods.

Provided vertically above one another in the side walls of the framing or support frame means 22 at the lower portions of each of the printing units (as best seen between the printing units 1 and 2; 2 and 3; and 3 and 4) are two bearing support holes 20 and 21. The upper, somewhat smaller bearing support hole 20 serves to hold the bearings of a sheet-transfer drum 13 of the single diameter. The lower, larger bearing support hole 21 serves to hold the bearings of a storage drum 15 having a double diameter. The preferred printing press 100 is provided with identical lower portions in the printing units which are configured to employ the normal sheet-transfer apparatus or a turning station 5. Each printing unit includes the two bearing support holes 20 and 21 in an arrangement vertically above one another. As a result, it is possible, firstly, to use the side walls of the framing 22 for the printing units for two separate types of machine. Secondly, it is of particular advantage, at any time after delivery of one machine, to convert a unit to another type of unit, if there is a change in a job structure or printing method.

It should now be clear that, if the operator of a preferred sheet-fed rotary printing press according to the invention wished to produce merely one-sided multicolor copies, it is advantageous, in the interests of economy and in order to avoid repeat marks, for all lower portions of printing units to be equipped with sheet-transfer drums 12, 13 and 14 of the single diameter. With such a configuration, there would be no turning station 5 between printing units 2 and 3. Instead, the transfer of sheets 7 between units 2 and 3 would be identical to that provided between units 1 and 2.

The invention as illustrated by the embodiments described hereinabove includes a four-color printing press, which is convertible to a two/two recto-and-verso printing press.

In summary, the sheet-fed rotary printing press of the present invention is for one-sided multi-color printing with an in-line arrangement of the printing units, with each printing unit comprising a plate cylinder, a blanket cylinder and an impression cylinder, all of single diameter, as well as three sheet-transfer drums. The invention is characterized in that provided vertically above one another in the side walls of the lower parts of each printing unit are two bearing holes 20, 21 for the mounting of the middle sheet-transfer drum 13 and in that it is possible to mount, alternatively, in the lower bearing hole 21, a storage drum 15 of double diameter for recto-and-verso printing or, in the upper bearing hole 20, a sheet-transfer drum 13 of single diameter.

U.S. Pat. No. 4,621,576 entitled "Sheet-Fed Rotary Printing Presses For Single-Side Printing Or First Form And Perfector Printing" discloses a sheet-fed rotary printing press including different transfer drums, storage drums and turning drums which are well-known to those skilled in the printing art.

For the preferred embodiment hereinabove, it should be clear that the support frame 22 for each of the printing units 1, 2, 3 and 4 could be alternatively configured while still providing the basic invention as claimed. For example, it would be possible for the support frame 22, between each printing unit, to have transitional or edge frame means which is not located specifically between transfer drums 12 and 13 but, alternatively, for example, between drums 13 and 14. In other words, while in the preferred embodiment the bearing support means 20 and 21 are associated with the entrance side of the printing unit, the same bearing support means 20, 22 could alternatively be associated with the exit side of the immediately preceding printing unit. It should be clear to those skilled in the printing art that the various printing units can be configured to provide the overall alternative configuration as described hereinabove without any need or requirement for the support frame of the various printing units to be exactly configured as they are for the preferred embodiment as described hereinabove. Clearly, alternative support framing could be used while still providing the invention as claimed.

In further summary, the invention relates to a sheet-fed rotary printing press for one-sided multicolor printing with an in-line arrangement of printing units, with each printing unit comprising a plate cylinder, a blanket cylinder and an impression cylinder, all of the same diameter, as well as three sheet-transfer drums, characterized in that provided vertically above one another in the side walls of the lower parts of each printing unit are two bearing holes 20, 21 for the mounting of the middle sheet-transfer drum 13 and in that it is possible to mount, alternatively, in the lower bearing hole 21, a storage drum 15 of double diameter for recto-and-verso printing or, in the upper hole 20, a sheet-transfer drum 13 of single diameter.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The invention as described hereinabove in the context of the preferred embodiments is not to be taken as limited to all of the provided details thereof, since modifications and variations thereof may by made without departing from the spirit and scope of the invention.

What is claimed is:

1. A method of configuring a printing unit selectively for recto printing and for recto-and-verso printing, said method comprising the steps of:

providing said printing unit with support frame means;

mounting at least a plate cylinder, a blanket cylinder and an impression cylinder, each of which has a first predetermined diameter, for rotation within said support frame means;

mounting at least one transfer drum, having said first predetermined diameter, for rotation within said support frame means in cooperation with said impression cylinder;

selectively supporting at one time only one of:
a first transfer drum during said recto printing, and
a turning drum during said recto-and-verso printing, at first bearing support means for causing said one of:
said first transfer drum, and
said turning drum at said first bearing support means, to be in cooperation with said impression cylinder, each of said first transfer drum and said turning drum having said first predetermined diameter;
selectively supporting a second transfer drum during said recto printing at second bearing support means for being in cooperation with said first transfer drum, said second transfer drum having said first predetermined diameter;
selectively supporting a storage drum during said recto-and-verso printing at third bearing support means for being in cooperation with said turning drum, said storage drum having a second predetermined diameter which is twice that of said first predetermined diameter;
utilizing said first transfer drum in said first bearing support means and said second transfer drum in said second bearing support means during said recto printing; and
utilizing said turning drum in said first bearing support means and said storage drum in said third bearing support means during said recto-and-verso printing.

2. The method according to claim 1, wherein said supporting said storage drum at said third bearing support means includes disposing said third bearing support means below said second bearing support means.

3. A sheet-fed rotary printing press comprising:
a plurality of printing units;
each of said printing units having support frame means;
each of said printing units having a plate cylinder, a blanket cylinder and an impression cylinder, each of which have a first predetermined diameter;
said plate cylinder, said blanket cylinder and said impression cylinder being mounted for rotation within said support frame means;
each of said printing units including at least one transfer drum in cooperation with its corresponding impression cylinder;
each of said transfer drums having said first predetermined diameter;
said support frame means including first means for selectively mounting at one time only one of:
a first of said transfer drums, and
a turning drum;
said turning drum having said predetermined first diameter;
said turning drum for being in cooperation with said impression cylinder;
said support frame means including second means for selectively mounting a second of said transfer drums for being in cooperation with said first of said transfer drums;
said support frame means including third means for selectively mounting a storage drum;
said storage drum having a second predetermined diameter which is twice that of said first predetermined diameter;
said storage drum for being in cooperation with said turning drum; and
the combination of said first means, second means and third means in a plurality of said printing units being configured for selectively including at one time only one of:
said second transfer drum and said first transfer drum in cooperation with said impression cylinder and
said storage drum and said turning drum in cooperation with said impression cylinder.

4. The sheet-fed rotary printing press according to claim 1, wherein said third means for selectively mounting is disposed vertically below said second means for selectively mounting.

5. The sheet-fed rotary printing press according to claim 1, wherein said second means for selectively mounting is horizontally disposed between said first means and said at least one transfer drum in cooperation with said impression cylinder of an immediately preceding one of said printing units of said plurality of said printing units.

6. The sheet-fed rotary printing press according to claim 1, wherein a first of said printing units includes one of said first of said transfer drums;
said second of said printing units includes one of said first of said transfer drums and one of said second of said transfer drums,
a third of said printing units includes said storage drum and said turning drum, and a fourth of said printing units includes one of said first of said transfer drums and one of said second of said transfer drums.

7. A printing unit for a sheet-fed rotary printing press including a plurality of said printing units, each said printing unit comprising:
support frame means;
a plate cylinder, a blanket cylinder and an impression cylinder, each of which has a first predetermined diameter;
said plate cylinder, said blanket cylinder and said impression cylinder being mounted for rotation within said support frame means;
at least one transfer drum for being mounted within said support frame in cooperation with said impression cylinder;
said at least one transfer drum having said first predetermined diameter;
said support frame means including first means for selectively mounting at one time only one of:
a first of said transfer drums, and
a turning drum;
said turning drum having said predetermined first diameter;
said turning drum for being in cooperation with said impression cylinder;
said support frame means including second means for selectively mounting a second of said transfer drums, said second of said transfer drums for being in cooperation with said first of said transfer drums;
said support frame means including third means for selectively mounting a storage drum;
said storage drum having a second predetermined diameter which is twice that of said first predetermined diameter;
said storage drum for being in cooperation with said turning drum; and
the combination of said first means, second means and third means in said printing unit being configured for selectively including at one time only one of:

said second transfer drum and said first transfer drum in cooperation with said impression cylinder, and said storage drum and said turning drum in cooperation with said impression cylinder.

8. The printing unit according to claim 5, wherein said third means for selectively mounting is disposed below said second means for selectively mounting.

9. A sheet-fed rotary printing press comprising:

a plurality of printing units;

each of said printing units having support frame means;

each of said printing units having a plate cylinder, a blanket cylinder and an impression cylinder, each of which have a first predetermined diameter;

said plate cylinder, said blanket cylinder and said impression cylinder being rotatably mounted on said support frame means;

each of said printing units including at least one transfer drum being rotatably mounted in cooperation with its corresponding impression cylinder;

each of said transfer drums having said first predetermined diameter;

said support frame means including first means for selectively mounting at one time only one of:

a first of said transfer drums, and a turning drum having said predetermined first diameter and for being rotatably mounted in cooperation with said impression cylinder;

said support frame means including second means for selectively mounting a second of said transfer drums for being in cooperation with said first of said transfer drums;

said support frame means including third means for selectively mounting a storage drum having a second predetermined diameter which is twice that of said first predetermined diameter and for being rotatably mounted in cooperation with said turning drum; and the combination of said first means, second means and third means in at least one of said printing units being configured for selectively including at one time only one of:

a first transfer drum and a second transfer drum, which first transfer drum is for being in cooperation with said impression cylinder and a storage drum and a turning drum, which turning drum is for being in cooperation with said impression cylinder.

10. The sheet-fed rotary printing press according to claim 9, wherein said third means for selectively mounting is disposed vertically below said second means for selectively mounting.

11. The sheet-fed rotary printing press according to claim 9, wherein said second means for selectively mounting is horizontally disposed between said first of said transfer drums means and said at least one transfer drum in cooperation with said impression cylinder of an immediately preceding one of said printing units of said plurality of said printing units.

12. The sheet-fed rotary printing press according to claim 9, wherein a first of said printing units includes one of said first of said transfer drums;

said second of said printing units includes one of said first of said transfer drums and one of said second of said transfer drums, a third of said printing units includes said storage drum and said turning drum, and a fourth of said printing units includes one of said first of said transfer drums and one of said second of said transfer drums.

* * * * *